US007021905B2

(12) United States Patent
Torrey et al.

(10) Patent No.: US 7,021,905 B2
(45) Date of Patent: Apr. 4, 2006

(54) FLUID PUMP/GENERATOR WITH INTEGRATED MOTOR AND RELATED STATOR AND ROTOR AND METHOD OF PUMPING FLUID

(75) Inventors: David A. Torrey, Ballston Spa, NY (US); Edward C. Kirchner, Pittsfield, MA (US)

(73) Assignee: Advanced Energy Conversion, LLC, Ballston Spa, NY (US)

( * ) Notice: Subject to any disclaimer, the term of this patent is extended or adjusted under 35 U.S.C. 154(b) by 145 days.

(21) Appl. No.: 10/702,354

(22) Filed: Nov. 6, 2003

(65) Prior Publication Data

US 2004/0265153 A1 Dec. 30, 2004

Related U.S. Application Data

(60) Provisional application No. 60/482,403, filed on Jun. 25, 2003.

(51) Int. Cl.
*F04B 17/03* (2006.01)

(52) U.S. Cl. ..... 417/356; 290/52; 310/54; 310/63; 417/366

(58) Field of Classification Search ..... 417/352, 417/353, 355, 356, 366; 290/52; 310/54, 310/59, 63

See application file for complete search history.

(56) References Cited

U.S. PATENT DOCUMENTS 1,996,460 A * 4/1935 Coates ..... 417/356
3,098,958 A * 7/1963 Katz ..... 318/138
3,143,972 A * 8/1964 Smith et al. ..... 417/356
3,348,490 A * 10/1967 Katz et al. ..... 417/356
3,422,275 A * 1/1969 Arthur et al. ..... 417/356
4,367,413 A * 1/1983 Nair ..... 290/52
5,088,899 A 2/1992 Blecker et al.
5,211,546 A * 5/1993 Isaacson et al. ..... 417/356
5,527,159 A * 6/1996 Bozeman et al. ..... 417/366
5,607,329 A * 3/1997 Cho et al. ..... 417/356
5,649,811 A * 7/1997 Krol et al. ..... 417/353
6,056,518 A 5/2000 Allen et al.
6,194,798 B1 * 2/2001 Lopatinsky ..... 310/63
6,499,966 B1 12/2002 Werson et al.
6,554,584 B1 4/2003 Takura et al.
6,856,053 B1 * 2/2005 LeFlem et al. ..... 310/54
6,903,471 B1 * 6/2005 Arimitsu et al. ..... 310/59

* cited by examiner

*Primary Examiner*—Michael Koczo, Jr.
(74) *Attorney, Agent, or Firm*—Hoffman, Warnick & D'Alessandro, LLC

(57) ABSTRACT

A fluid pump integrated with a motor, a fluid pump/generator device, a rotor for a fluid pump/generator device, a stator for a fluid pump/generator device and a method for pumping fluid are disclosed. Specifically, a fluid pump includes a motor rotor having a plurality of magnetic vanes that electromagnetically interact with a plurality of magnetic poles of the motor stator such that the rotor functions simultaneously as the impeller for the pump and rotor for the motor, with fluid flowing through channels on the rotor. Pump and motor are tightly integrated into one single device so that the number of parts is reduced, total size is compressed, reliability of the device is improved, and cost efficiency is increased. In addition, the use of magnetic vanes for propelling fluid improves motor efficiency. Further, the fluid flow is used to directly cool the pump/generator device, which reduces energy consumption.

25 Claims, 18 Drawing Sheets

FLUID PUMP/GENERATOR WITH INTEGRATED MOTOR AND RELATED STATOR AND ROTOR AND METHOD OF PUMPING FLUID

This application claims the benefit of U.S. Provisional Application No. 60/482,403, filed Jun. 25, 2003, under 35 U.S.C. 119(e).

BACKGROUND OF THE INVENTION

1. Technical Field

The present invention relates to a fluid pump/generator. Specifically, a fluid pump/generator in which the rotor includes magnetic vanes that act as an impeller and interact with magnetic poles of the stator.

2. Related Art

In conventional electrically driven pumps, the pump and motor are connected through a shaft and the pump and the motor are each contained within their own housing. The disadvantages of the conventional pump, inter alia, includes: economic inefficiency due to the use of both motor and pump and increased parts; higher energy consumption due to the cooling of motor; low reliability due to the interaction between motor and pump; and increased size. Some previous attempts have been made to eliminate these disadvantages of a conventional pump.

Allen et al. (U.S. Pat. No. 6,056,518) discloses an electrically driven fluid pump that includes an integrated motor. However, this apparatus still uses both a motor and a pump, with fluid flowing around the motor.

Takura et al. (U.S. Pat. No. 6,554,584 B2) discloses an electrically driven fluid pump that integrates some protrusions and some recesses in the outer circumference of a rotor of a motor. The rotor is caused to rotate to cause fluid to be drawn in at a suction port on one end of the rotor and discharged at the other end of the rotor. However, removal of material from the rotor to form the recessions fundamentally limits efficiency because motor efficiency will tend to drop as additional material is removed from the rotor for the sake of improving pumping efficiency.

Werson et al. (U.S. Pat. No. 6,499,966 B1) discloses an electrically driven fluid pump. However, as in Allen, the motor and pump are two separate systems.

In view of the foregoing, there is a need in the art for a way to integrate a fluid pump and motor more closely and eliminate the deficiencies of the prior art.

A switched-reluctance motor (SRM) is a suitable type of motor for such integration. FIG. 1 (Prior Art) shows a three-phase 24/16 SRM. The SRM comprises steel laminations on the stator and rotor and windings placed around each salient pole of the stator, though there are other ways to wind the SRM. There are no windings or permanent magnets on the rotor, making the structural integrity of the rotor compatible with operation at very high speeds.

SUMMARY OF THE INVENTION

The present invention includes a fluid pump integrated with a motor, a fluid pump/generator device, a rotor for a fluid pump/generator device, a stator for a fluid pump/generator device and a method for pumping fluid. Specifically, a fluid pump includes a motor rotor having a plurality of magnetic vanes that electromagnetically interact with a plurality of magnetic poles of the motor stator such that the rotor functions simultaneously as the impeller for the pump and rotor for the motor, with fluid flowing through channels on the rotor. Pump and motor are tightly integrated into one single device so that the number of parts is reduced, total size is compressed, reliability of the device is improved, and cost efficiency is increased. The fluid flow is used to directly cool the pump/generator device, which reduces the size of the generator.

A first aspect of this invention is directed to a fluid pump comprising: a motor including: a stator having a plurality of magnetic poles and at least one phase winding; and a rotor having a plurality of magnetic vanes for electromagnetically interacting with the plurality of magnetic poles, and a fluid carrying channel between adjacent magnetic vanes.

A second aspect of this invention is directed to a fluid pump/generator device comprising: a stator having a plurality of magnetic poles and at least one phase winding; and a rotor having a plurality of magnetic vanes for electromagnetically interacting with the plurality of magnetic poles, and a fluid carrying channel between adjacent magnetic vanes.

A third aspect of this invention is directed to a method of pumping fluid, the method comprising the steps of: directing fluid into a rotor of a motor; and propelling the fluid using a plurality of magnetic vanes on the rotor, each magnetic vane being angled relative to an axial direction.

A fourth aspect of this invention is directed to a rotor for a fluid pump/generator, the rotor comprising: a plurality of magnetic layers having a plurality of magnetic vanes formed in an exterior surface thereof; and a plurality of fluid carrying channels between adjacent magnetic vanes.

A fifth aspect of this invention is directed to a stator for a fluid pump/generator, the stator comprising: a plurality of magnetic layers having a plurality of magnetic poles formed in an exterior surface thereof; and a plurality of winding channels between adjacent magnetic poles, each winding channel allowing fluid flow therethrough.

The foregoing and other features of the invention will be apparent from the following more particular description of embodiments of the invention.

DETAILED DESCRIPTION OF THE INVENTION

Overall System

Figure 1:
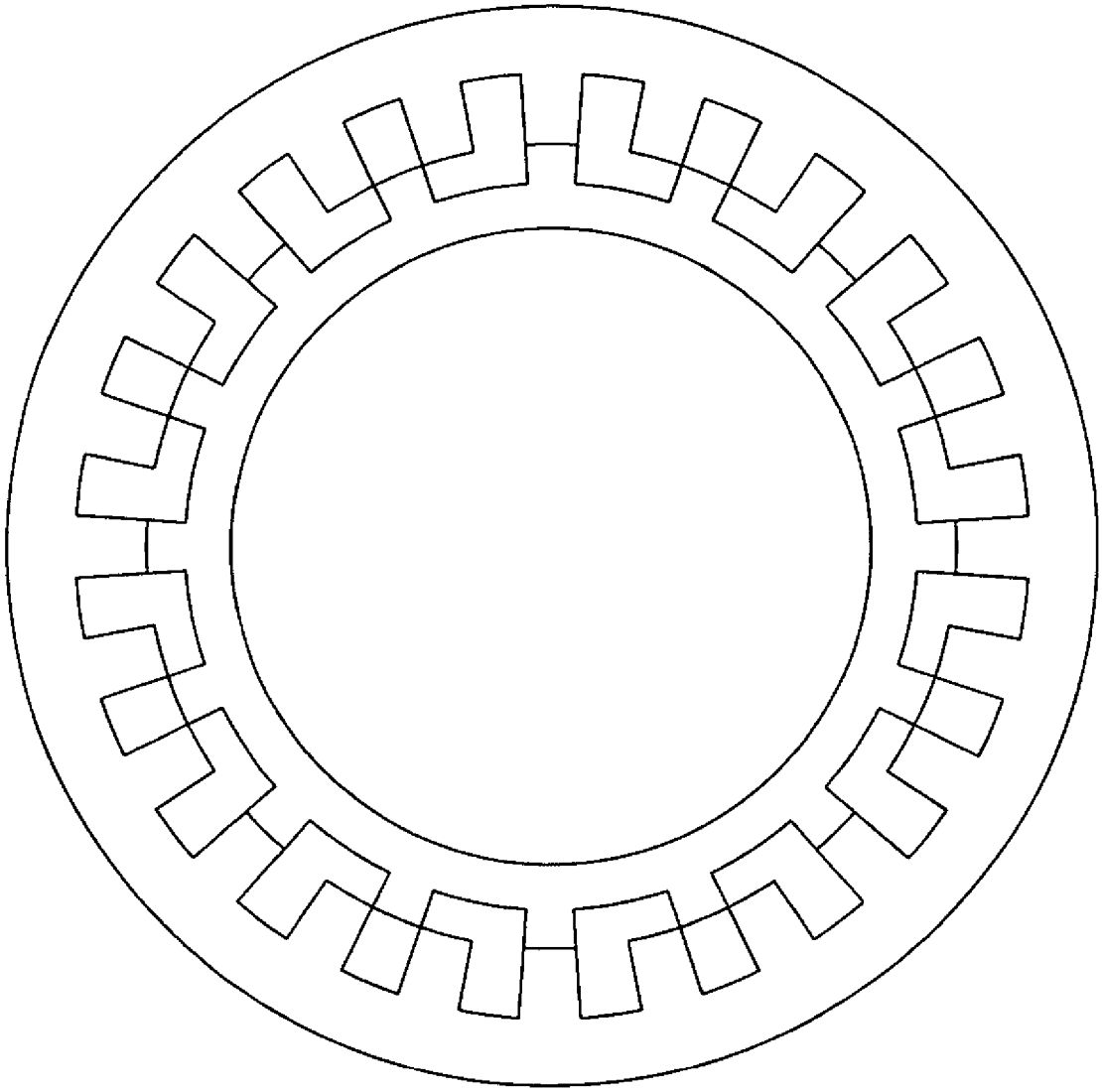
FIG. 1 PRIOR ART
FIG. 1 shows a cross-sectional view of a prior art three-phase switched-reluctance motor.
Figure 2A:
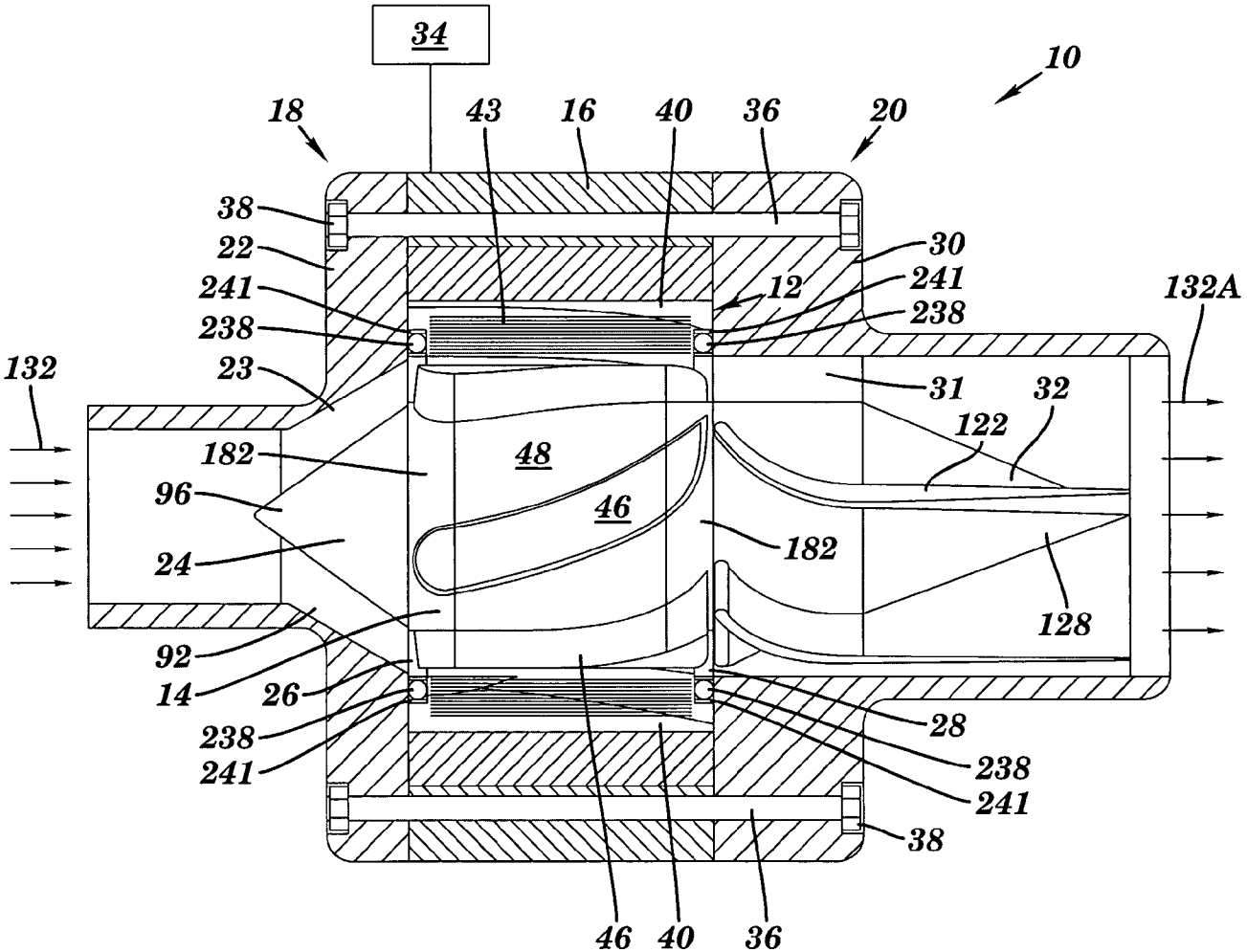
FIGS. 2A–B shows a partial cross-sectional view of a first embodiment of a fluid pump/generator according to the invention.
Figure 2B:
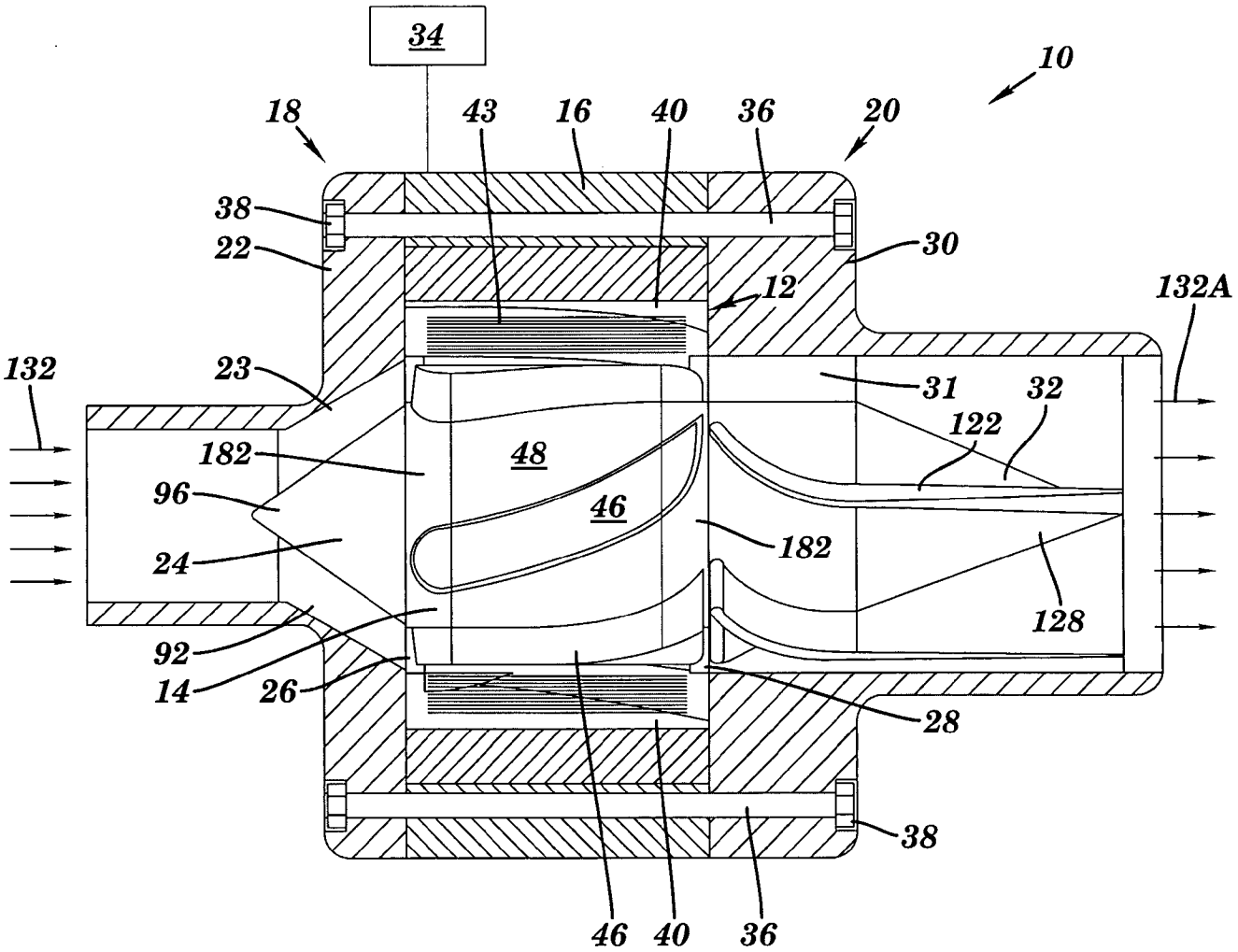

FIG. 2A is a partial cross-sectional view of a first embodiment of a fluid pump/generator device 10 (hereinafter "fluid pump" unless otherwise necessary) in accordance with the invention. Fluid pump 10 includes a motor having a stator 12 having a plurality of magnetic poles 40 and at least one phase winding 43; and a rotor 14 having a plurality of magnetic vanes 46 for electromagnetically interacting with the plurality of stator magnetic poles 40, and a fluid carrying channel 48 between adjacent magnetic vanes 46. Fluid pump 10 also includes a motor housing 16 for enclosing stator 12 and rotor 14, an inlet housing 18 and an outlet housing 20 for constraining stator 12 and rotor 14 axially and radially. Magnetic vanes 46 electromagnetically interact with stator magnetic poles 40 such that rotor 14 functions simultaneously as the impeller for the pump and rotor for the motor, with fluid flowing axially along the rotor via fluid carrying channels 48. FIG. 2B is a partial cross-sectional view of the first embodiment of fluid pump 10 with a central rotor shaft (not shown) rather than an outer bearing 238 for supporting rotor 14, as will be described in greater detail below.

Inlet housing 18 includes an outer annulus structure 22 having a passage 23 therethrough and a nose structure 24 in passage 23. An inlet side 26 of motor housing 16 contacts inlet housing 18. An outlet side 28 of motor housing 16 contacts outlet housing 20. Outlet housing 20 includes an outer annulus structure 30 having a passage 31 therethrough and a tail structure 32 in passage 31. A motor control module (MCM) 34 is positioned outside fluid pump 10 to control the operation of the fluid pump.

Figure 3:
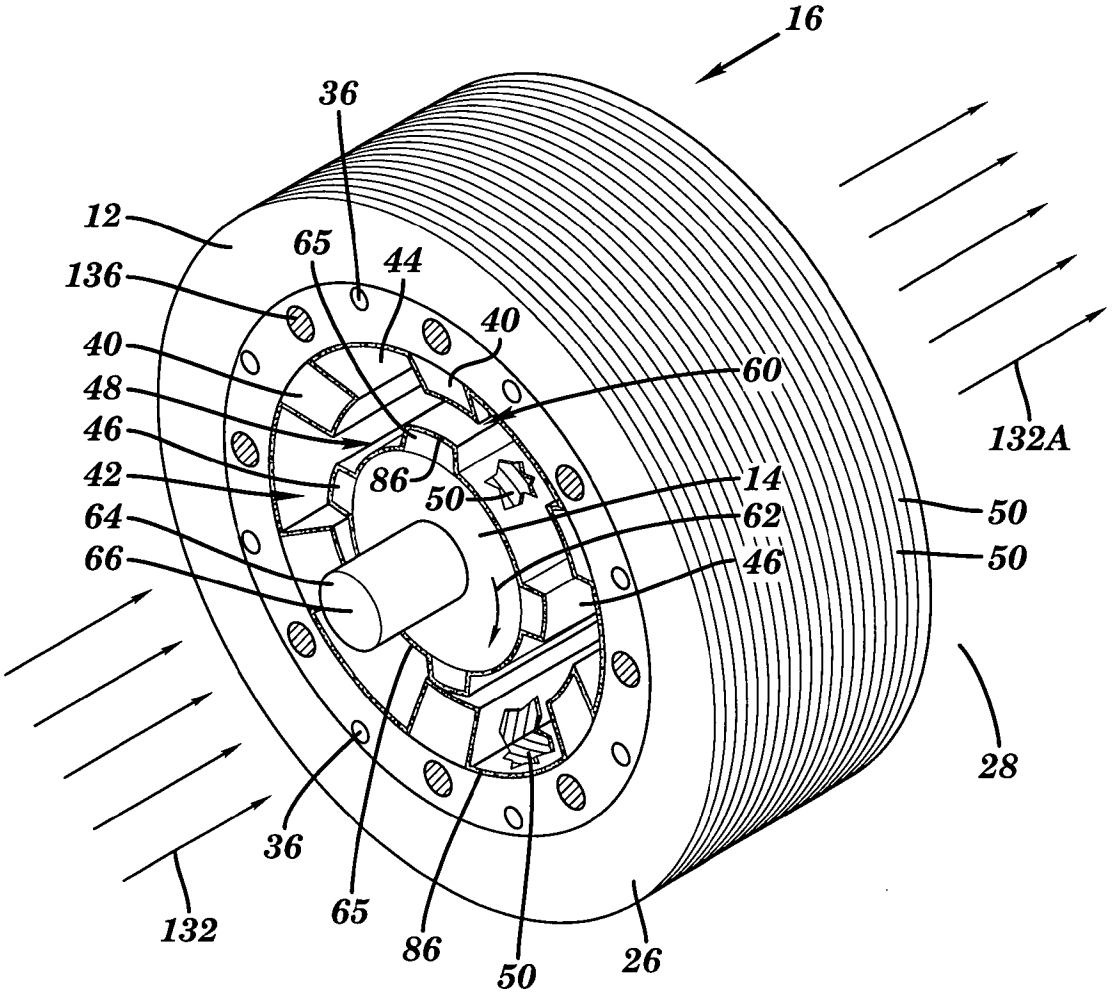
FIG. 3 shows a perspective view of a stator and a rotor in a motor housing of FIG. 2.

Referring to FIGS. 2A–3, there are numerous holes 36 in motor housing 16, which go through motor housing 16 from inlet side 26 to outlet side 28. Inlet housing 18 and outlet housing 20 are affixed to motor housing 16 by a plurality of fasteners 38 (See FIGS. 2A–B) extending into holes 36. It is also appreciated that there are numerous methods whereby housings 18 and 20 are affixed to housing 16 directly without going beyond the scope of this invention. It is also recognized that there are other mounting mechanisms whereby components, including but not limited to motor housing 16, inlet housing 18 and outlet housing 20, of fluid pump 10 are held together.

Motor Housing, Stator and Rotor

Figure 4:
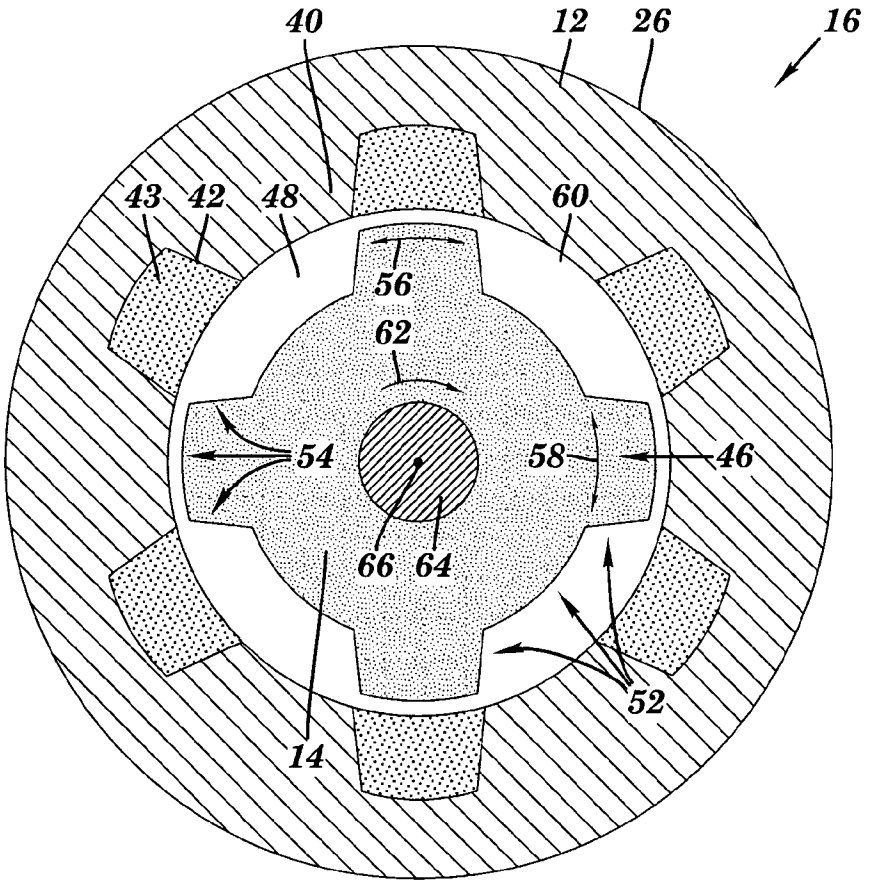
FIG. 4 shows a cross-sectional view of a stator and a rotor in a motor housing of FIG. 2.

FIG. 3 shows a perspective view of a motor housing 16, including stator 12 and rotor 14, and associated parts. Stator 12 includes a plurality of magnetic poles 40 (six are shown in this embodiment) and a plurality of winding channels 42 between adjacent magnetic poles 40 (six are shown in this embodiment). Each of the plurality of winding channels 42 are positioned between adjacent magnetic poles 40. As shown in FIG. 4, the plurality of winding channels 42 are provided in part to position at least one phase winding 43 therethrough. Stator 12 and magnetic poles 40 include a plurality of layers of magnetic material 44. In one embodiment, stator 12 and the integral magnetic poles 40 are created by stacking stampings of magnetic electrical sheet steel, e.g. M-19 or low carbon silicon iron, to create a laminated stack. It is appreciated that there are other ways of creating stator 12 without going outside the scope of this invention, such as the casting of powdered iron ceramic material.

Rotor 14 includes a plurality of magnetic vanes 46 on an outer diameter (four are shown in this embodiment) and a plurality of fluid carrying channels 48 between adjacent magnetic vanes 46 (four are shown in this embodiment). Rotor 14 and vanes 46 include a plurality of layers of magnetic material 50. As with stator 12 and magnetic poles 40, in one embodiment, rotor 14 and vanes 46 are created by stacking stampings of magnetic electrical sheet steel or by some other method to create a magnetic structure with high permeability.

FIG. 4 shows a cross sectional view of stator 12 and rotor 14 in motor housing 16 of FIGS. 2A–B. In one embodiment, magnetic vanes 46 each have a trapezoidal shape 54, and consequently, flow-carrying channels 48 each have an inverted trapezoidal shape 52. In particular, each vane 46 may have a face width 56 that is less than a corresponding base width 58. At least one phase winding 43 is positioned between adjacent magnetic poles 40. There is a minimum gap 60 between poles 40 and vanes 46 that is consistent with achievable manufacturing tolerances. The trapezoidal shape of magnetic poles 40 is desirable to add strength to poles 40 and to focus magnetic saturation near gap 60. It will be appreciated that this is an attribute of a well-designed SRM but is not a limitation of this invention.

Figure 6:
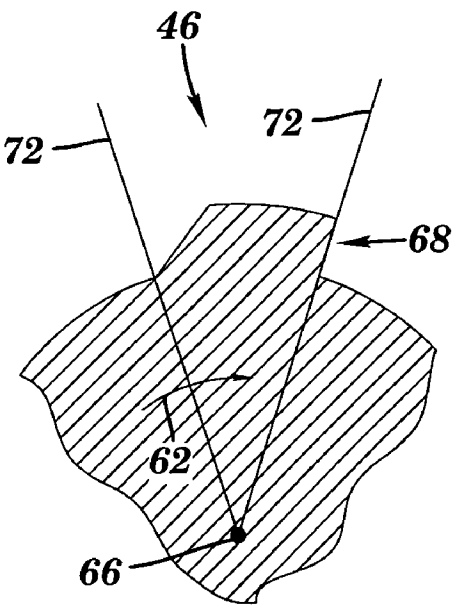
FIGS. 5, 6, 7, 8 show various embodiments of magnetic vane shape in a lateral cross-sectional view.
Figure 5:
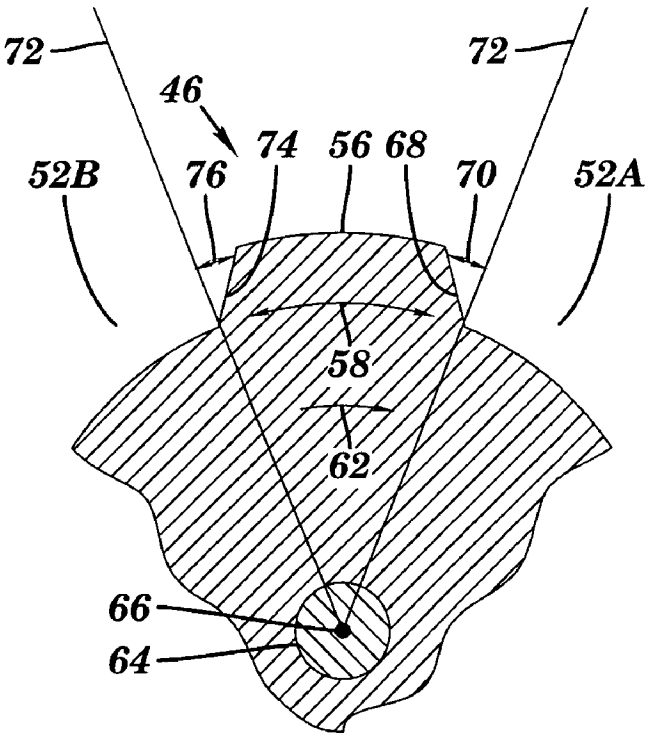
Figure 8:
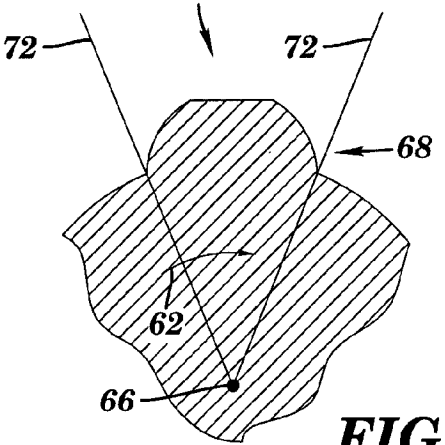
Figure 7:
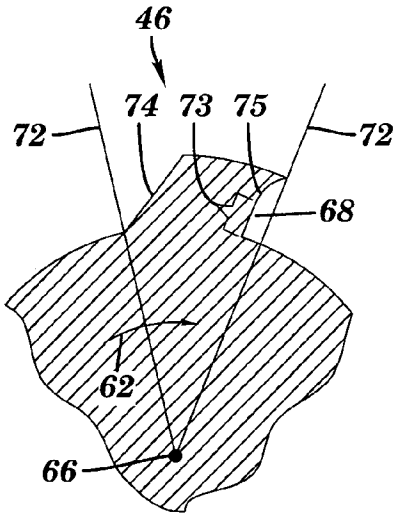

FIG. 5 is an enlarged lateral cross-sectional view of a single magnetic vane 46 shown in FIG. 4. Magnetic vane 46 is mounted to a rotor shaft 64, with the assembly moving in a clockwise (CW) rotation 62 about a center of rotation 66. Each magnetic vane 46 may also include a leading edge 68 having an angle 70 with respect to a radial line 72 projecting out from the center of rotation 66; and a trailing edge 74 having an angle 76 with respect to a radial line 72 projecting out from center of rotation 66; and a leading flow channel 52A and a trailing flow channel 52B; and a face width 56 and a base width 58, face width 56 being less than base width 58, as described above. In the embodiment shown in FIG. 5, angle 70 equals angle 76. To achieve other preferred characteristics, angle 70 and angle 76 may be changed, either increasing or decreasing as to remain equal to one another or different from one another in a positive or negative sense, so long as length 56 remains shorter than length 58. Similarly trailing edge 74 and/or leading edge 68 may be straight or curved, either in unison or singularly. Three alternative embodiments are indicated in FIGS. 6, 7 and 8. FIG. 6 shows an embodiment of vane 46 having a leading edge 68 on a radial line 72 projecting out from center of rotation 66. FIG. 7 shows an embodiment of vane 46 having a curved shaped leading edge 68 and a straight trailing edge 74. The curved shaped leading edge 68 includes a flat lower portion 73 and a curved upper portion 75 (FIG. 7). FIG. 8 shows a magnetic vane 46 having an involute shape, the shape that is used to produce such parts as spur gears. It should be recognized that other combinations of shapes are also possible and do not depart from the scope of this invention.

Figure 9:
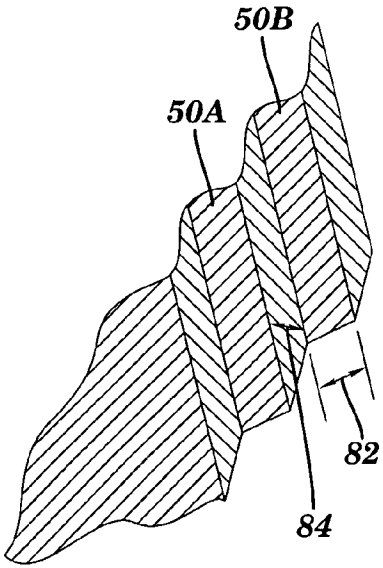
FIG. 9 shows a schematic view of the skewing of layers of material that form the rotor.
Figure 10:
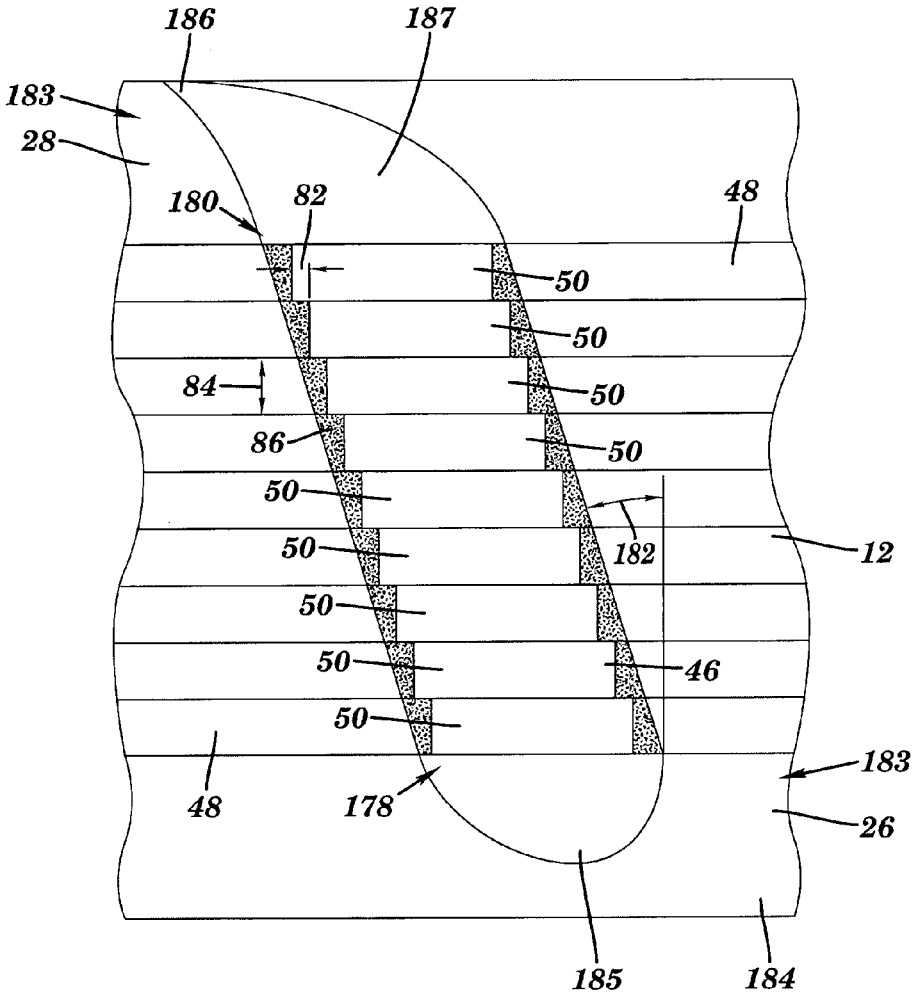
FIG. 10 and FIG. 11 show two embodiments of a plurality of layers that form a magnetic vane.

Fluid pump 10 can propel fluid in a number of ways. Turning to FIGS. 9 and 10 (also shown in FIGS. 2A–B), in a first embodiment, each magnetic pole 40 and/or magnetic vane 46 can include an angle relative to an axial direction of fluid pump 10 that is formed by circumferentially offsetting each (or a large number of) layer 50 of the respective member, i.e., stator or rotor, relative to an adjacent layer to form the angled shape in a process referred as "skewing." That is, there is a circumferential rotation 82 of a layer 50A with respect to a layer 50B and a layer 50A. The angled shape of a vane 46 or pole 40 is partly determined by rotation 82 of one layer of magnetic material with respect to another and a thickness 84 of each layer. It is appreciated that the skewing need not be constrained to a fixed offset over the axial length of stator 12 and/or rotor 14. That is, vanes 46 and/or poles 40 may take a curved shape. By virtue of the salient magnetic sections, i.e., vanes and poles, on rotor 14 and stator 12, the combination constitutes an SRM capable of propelling fluid. The rest of the shape of vane 46 may be determined by consideration of the mechanics associated with transferring energy to the fluid (in the case of a pump). The magnetics and fluid mechanics can be satisfied simultaneously through lamination design, skewing, and/or modification of the physical shape of vanes 46 through the addition of nonmagnetic material on the leading edge, the trailing edge and the interpolar spaces along vanes 46.

To provide efficient motor operation, rotor magnetic vanes 46 are axially aligned relative to one another. Similarly, stator magnetic poles 40 are axially aligned relative to one another. Furthermore, vanes 46 are aligned to the plurality of magnetic poles 40. That is, the geometries of the plurality of magnetic vanes 46 and the plurality of magnetic poles 40 are axially, i.e., parallel aligned. Skewing of vanes 46 may follow the skewing of stator poles 40. However, it will be appreciated by one skilled in the art that differential skewing may be useful in modifying the energy conversion characteristics of the pump.

Figure 11:
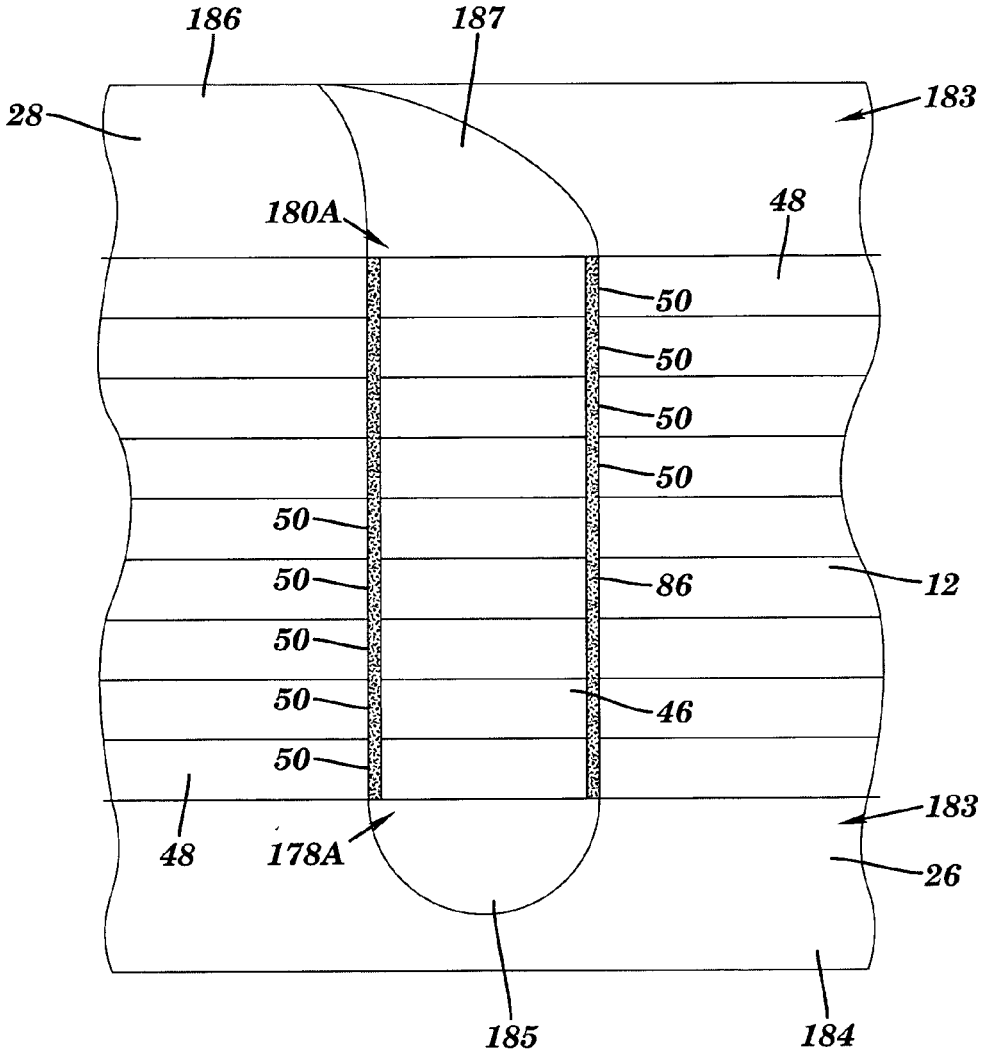

FIG. 10 illustrates an embodiment of a plurality of layers of magnetic material that form a magnetic vane 46, which conforms to that shown in FIGS. 2A–B. Leading edge 178 and trailing edge 180 of vane 46, comprising layers 50, are flat and co-planer. Layers 50 are offset to form an axially helix angle 182. In yet another embodiment described in FIG. 11, leading edge 178A and trailing edge 180A of vanes 46, constructed of layers 50, are flat and co-planer, and leading edge 178A and trailing edge 180A remain co-axial. In either embodiment, edge transition units 183 that mate with respective leading 178, 178A and trailing 180, 180A edges may be provided to reduce drag. A leading edge transition unit 184 may include rounded ends 185 to mate to vanes 46, while a trailing edge transition unit 186 may include trailing points 187 to mate to vanes 46 Transition units 183 may be machined parts that are added to each end of rotor 14. It should be recognized, however, that vane 46 shape and the leading edge 178, 178A and trailing edge 180, 180A geometrical changes can be provided to more effectively use magnetic flux flow and enhance pump efficiency by more effectively using flow channel 48 and fluid interactions.

Returning to FIG. 3 and FIG. 10, a surface coating 86 having a low electrical conductivity and low relative permeability (since these properties affect parasitic loss in the coating) may be applied to all surfaces that come in contact with the pumped fluid for corrosion resistance, and for reducing the surface roughness to enhance fluid flow. Surface coating 86 may include, for example, Loctite 609 (approximately 0.001" thick) or chrome plating (approximately 0.0005" thick). The thickness of surface coating 86 is minimized in order not to increase the thickness of air gap 60, since such increases reduce the performance of the motor.

As herein and previously described, magnetic vanes 46 can be straight, curved, helically curved, or airfoil like curved, each shape providing for a specific performance enhancing function. It is obvious that these performance enhancing embodiments can be combined in various and numerous ways to produce a very large number of performance enhancing embodiments, all of which are within the scope of this invention.

Inlet Housing

Figure 12:
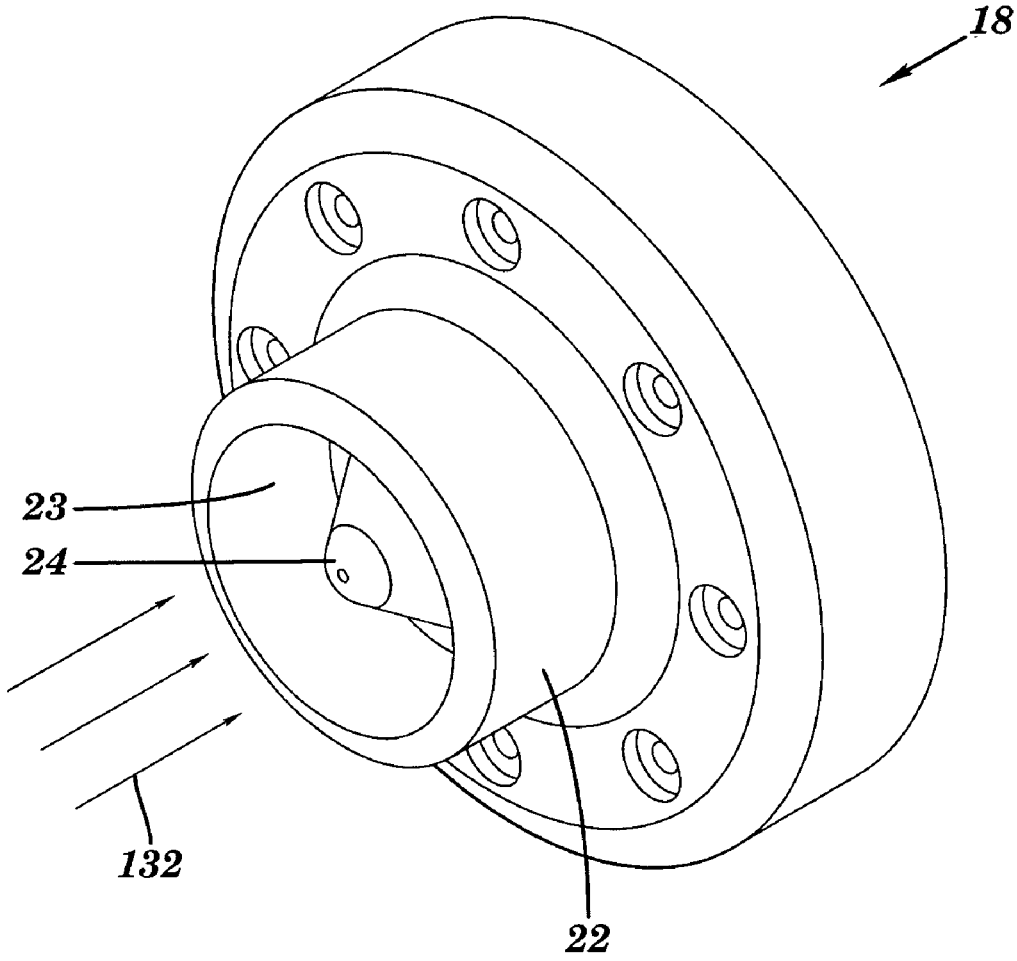
FIG. 12 shows a perspective view of one embodiment of an inlet housing.
Figure 13:
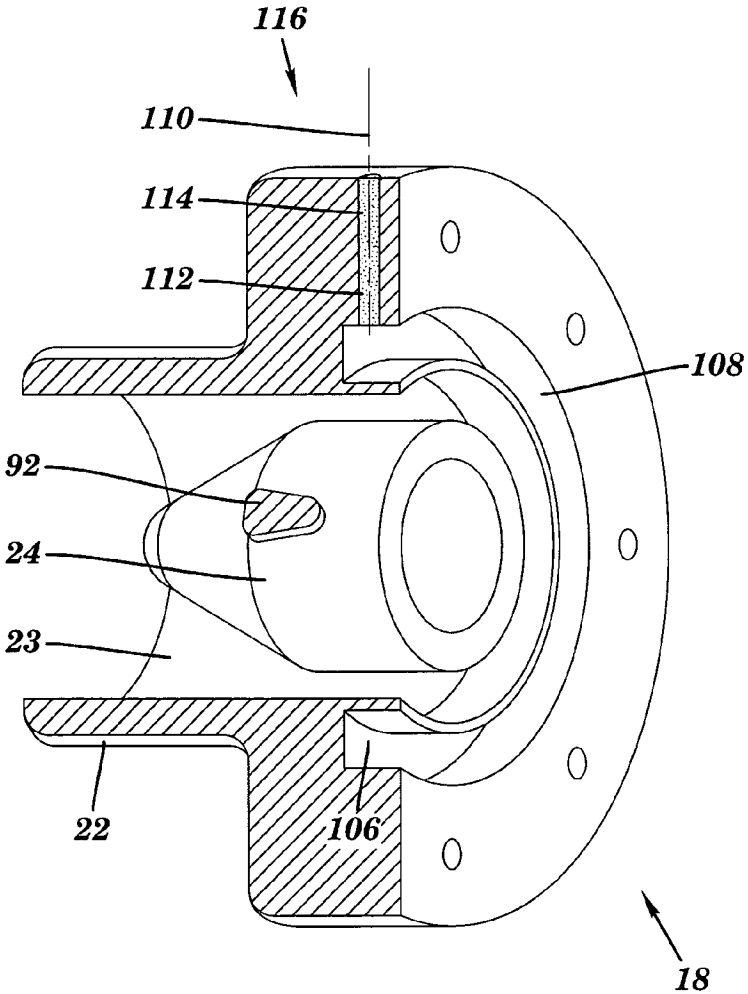
FIG. 13 shows a perspective and partial cross-sectional view of the inlet housing of FIG. 12.

FIG. 12 illustrates, in perspective view, the details of an inlet housing 18 similar to that of FIG. 2B, and FIG. 13 shows a perspective and partial cross-sectional view of an inlet housing 18 similar to that of FIG. 2B. As shown in FIG. 12 and FIG. 13, inlet housing 18 includes an outer annulus structure 22 having a passage 23 therethrough and a nose structure 24 in passage 23. Nose structure 24 is coupled to outer annulus structure 22 by a plurality of vane structures 92. Preferably, outer annulus structure 22, vane structures 92 and nose structure 24 are one piece. Outer annulus structure 22 inner diameter may nominally equal rotor 14 outer diameter. The number of vane structures 92 can vary without going outside the scope of this invention, however, good design practice dictates that the number of rotor magnetic vanes 46 be different from the number of vane structures 92. Vane structures 92 may extend directly from nose structure 24 (FIGS. 2A–B) or, if provided, from a cylindrical trailing portion thereof (FIG. 13).

Figure 14:
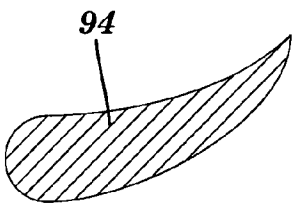
FIG. 14 shows an embodiment of a shape of a vane structure of FIG. 14.

Vane structures 92 are of a shape that is conducive to proper fluid flow around the vane structures, such as a straight airfoil as indicated in FIG. 13. However, another embodiment, shown in FIG. 14, includes a specially designed curved shape vane 94 similar to a highly cambered airfoil to further enhance fluid flow and hence pump performance.

Figure 15:
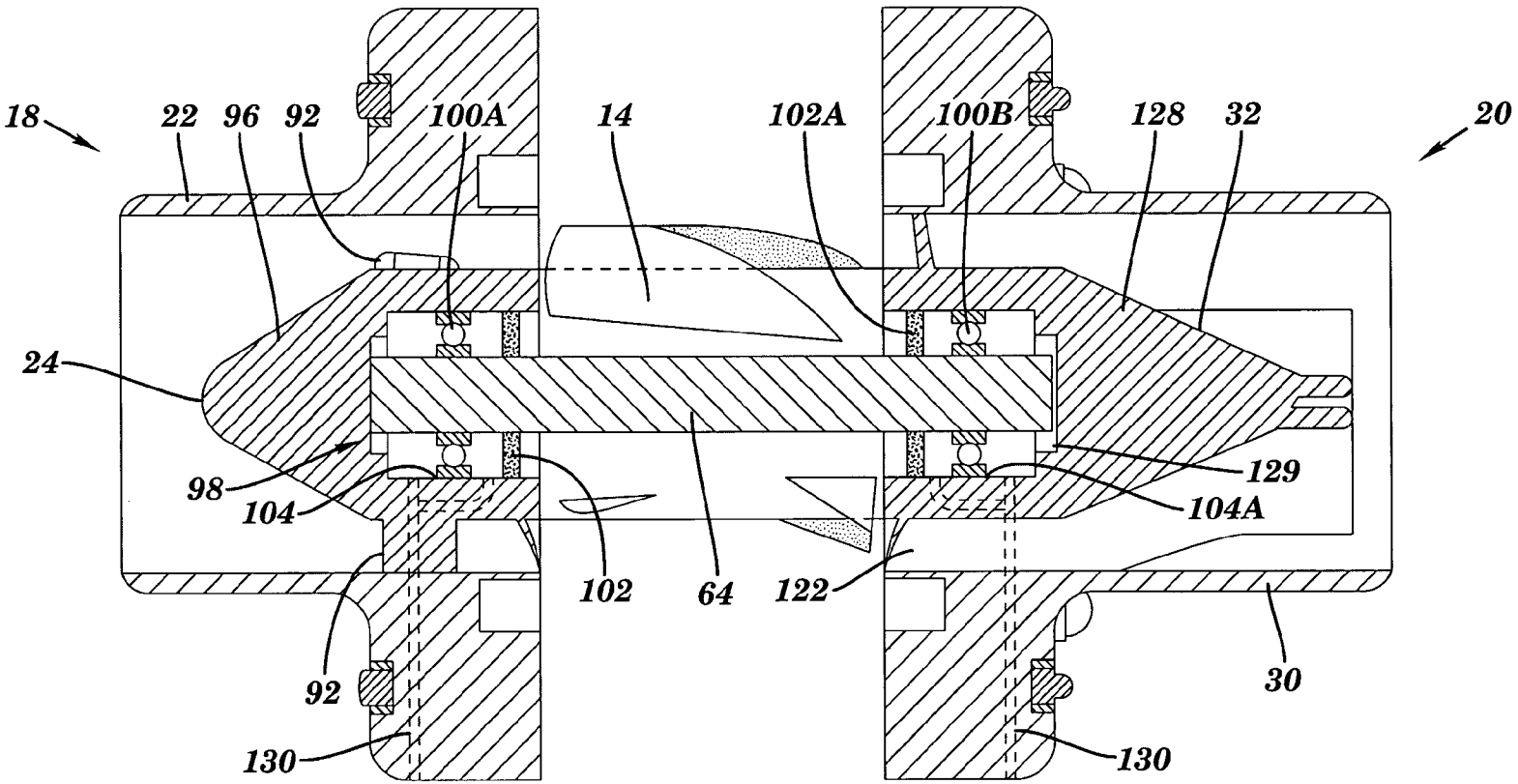
FIG. 15 shows a cross-sectional view of a rotor support system with a stator removed for clarity.

Referring to FIG. 15, nose structure 24 includes a round or parabolic ended cylinder 96 onto which vane structures 92 are attached. An outer diameter of cylinder 96 may nominally equal to a root diameter 65 (FIG. 3) of rotor 14. The round or parabolic shape of cylinder 96 enables fluid flow to gently separate and flow, with minimal energy loss and turbulence into the inlet side 26 of motor housing 16. In one embodiment, a rotor support system 98 may be contained within nose structure 24. Rotor support system 98 includes a rotor shaft 64, a support bearing 100A, which supports rotor shaft 64 and hence rotor 14 on inlet side 26, and shaft seal 102, which prevents leakage into bearing 100A. Nose structure 24 of inlet housing 18 further comprises bearing seat 104 for holding rotor support bearing 100A.

In an alternative embodiment, shown in FIG. 2A, rotor 14 is supported by bearings on an outer diameter of the rotor such that inlet housing 18 (and outlet housing 20) does not need special structure to support rotor 14. In this case, bearings 238 rotatably and axially constrain rotor 14 relative to stator 12, holding gap 60 between stator 12 and rotor 14. Bearings 238 are attached to rotor 14 and stator 12 on inlet side 26 and outlet side 28. Bearings 238 are extended in pockets or seats 241 that are placed within the rotor's flow channels 48 and vanes 46, and the stator's winding channels 42 and magnetic poles 40. It should be recognized by one skilled in the art that winding and flow channel design aspects will have to be accounted for, due to said bearings' location requirements. Other methods of dual end constraints, affixed to the outer diameter of the rotor, such as, but not limited to sleeve type bearings, hydrodynamic, and hydrostatic bearings do not depart from the scope of this invention. It will also be appreciated that it is possible to use a single bearing to constrain the rotor relative to the stator, such single bearing being located anywhere along the rotor.

Returning to FIG. 13, inlet winding channels 106 are contained within outer annulus structure 22. Inlet winding channels 106 provide space for windings 43 (FIG. 2) to wrap around stator poles 40. Additionally, inlet winding channels 106 provide space for conductor termination and connection 108 to conductors 110 that communicate to the pump exterior via conductor channel 112. Sealing, insulating and strain relief 114 material provide protection and seal pumping fluid from exiting fluid pump/generator device 10. Conductor exiting 116, which includes conductors 110, material 114, and channel 112, may occur at any convenient circumferential location on inlet housing 18. In another embodiment conductor exiting 116, which includes conductors 110, material 114, and an exiting channel similar to channel 112, may occur at any convenient location on inlet housing 18 or outlet housing 20 or motor housing 16.

In another embodiment, motor control module 34 may be integral to inlet housing 18, motor housing 16 or outlet housing 20. This integration serving to provide liquid cooling of motor control module 34 in a manner similar to the cooling of the stator winding 43, as herein described.

Outlet Housing

Figure 16:
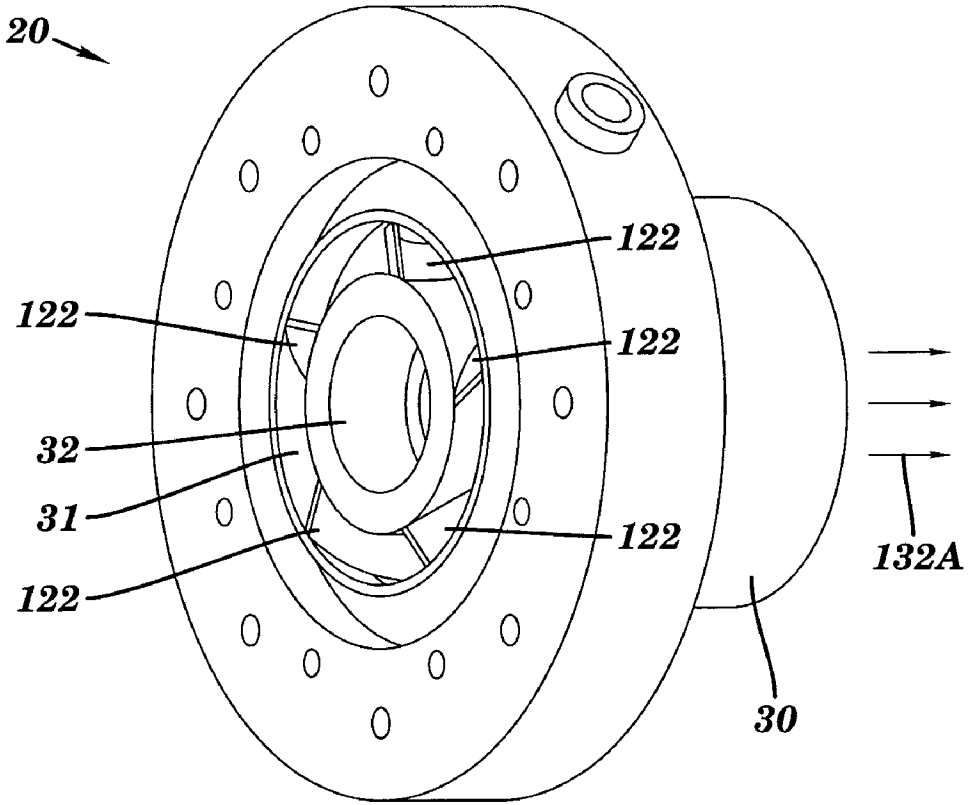
FIG. 16 shows a perspective view of one embodiment of an outlet housing.
Figure 17:
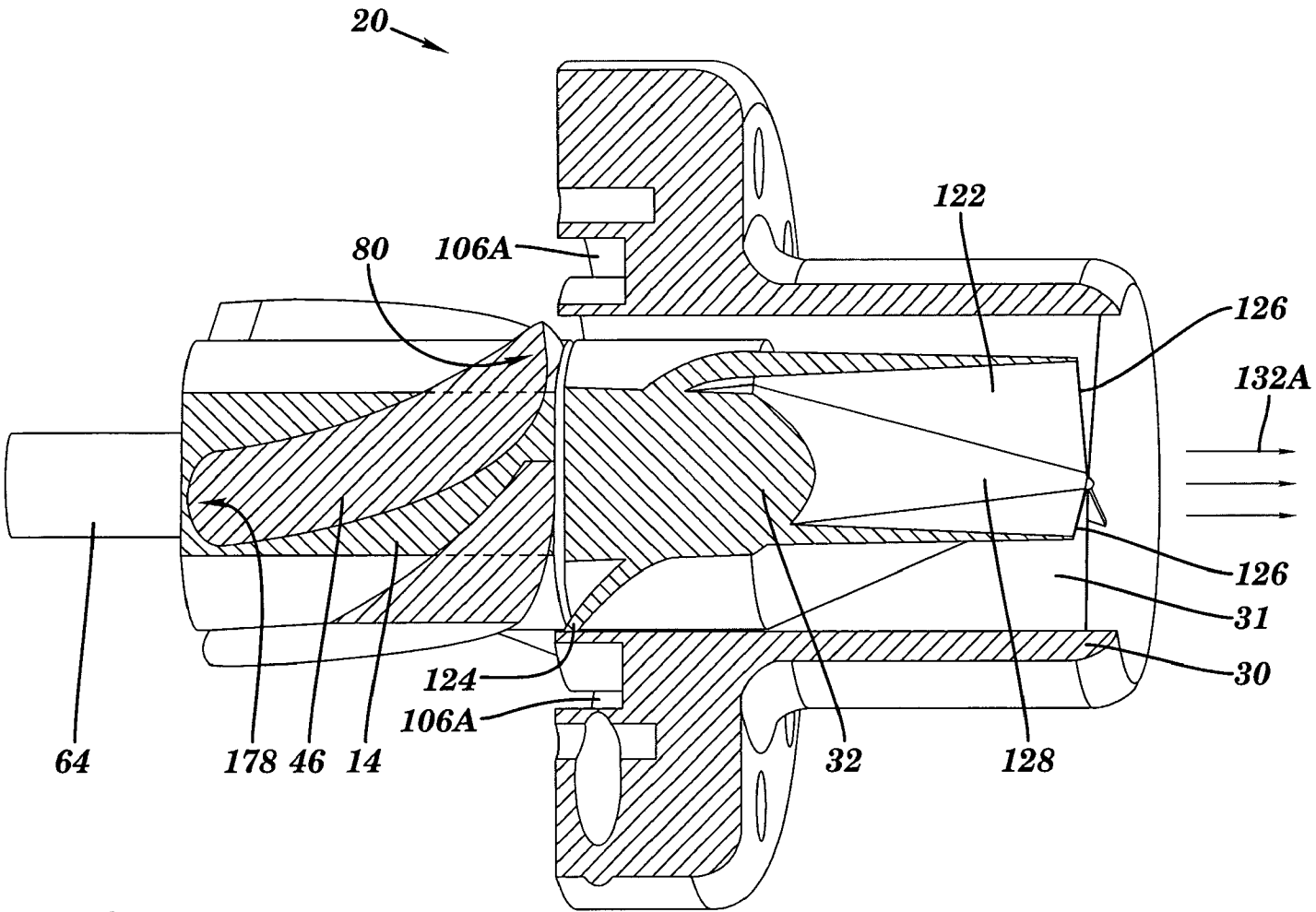
FIG. 17 shows a perspective and partial cross-sectional view of the outlet housing of FIG. 16.

With respect to FIG. 16, a perspective view of outlet housing 20 of FIG. 2B is shown. Similarly, FIG. 17 shows a perspective and partial cross-sectional view of outlet housing 20 of FIG. 2B. As shown in FIGS. 16 and 17, outlet housing 20 includes an outer annulus structure 30 having a passage 31 therethrough and a tail structure 32 in passage 31. Tail structure 32 is coupled to outer annulus structure 30 by a plurality of vane structures 122. Outer annulus structure 30, vane structures 122 and tail structure 32 are preferably one piece. Outer annulus structure 30 inner diameter may nominally equal rotor 14 outer diameter. The number of vane structures 122 can vary without going outside the scope of this invention, however, good design practice dictates that the number of rotor magnetic vanes 46 be different from the number of vane structures 122.

Referring to FIG. 17, a plurality of vane structures 122, each having a curved shape similar to an airfoil design, with a rounded leading edge 124 narrowing to a thin section, traverse outlet housing 20 in a helical like manner and terminate in a radially extending and co-axial trailing edge 126. Vane structures 122 are shaped to remove rotational velocity components and transition fluid flow to increase flow pressure with minimum energy loss.

Returning to FIG. 15, tail structure 32 includes a cone like ended cylinder 128 onto which vane structures 122 are attached. Cylinder 128 has an outer diameter, which may nominally equal to the root diameter 65 (FIG. 3) of rotor 14. Cone ended cylinder 128 and vane structures 122 cause exiting fluid flow to gently come together, with minimal energy loss and minimal turbulence and minimal separation out from outlet side 28 of rotor 14. In one embodiment, tail structure 32 may include a rotor support system 129, which includes a rotor shaft 64, support bearing 100B which supports rotor shaft 64 of rotor 14 on outlet side 28, and shaft seals 102A which prevent leakage into bearing 100B. Tail structure 32 further includes a bearing seat 104A for holding rotor support bearing 100B. Alternatively, as shown FIG. 2A, rotor support system 129 may be eliminated when rotor 14 is supported by bearings 238 within motor housing 16.

As shown in FIG. 17, outlet winding channels 106A may also be contained within outer annulus structure 30. Outlet winding channel 106A allows space for windings 43 (FIG. 4) to wrap around the plurality of magnetic poles 40. Additionally, this area provides space for conductor termination and connection. It will be appreciated that space for conductor termination, connection and exit need only be provided in either inlet housing 18 or outlet housing 20, with only space for stator phase windings being provided in the other housing. The choice of which housing is used for phase lead egress is immaterial to the operation of the pump.

Referring back to FIG. 15, in a preferred embodiment weep holes 130 communicate to the exterior of the pump, through vanes 92 and/or vanes 122 and drain any leakage. In another embodiment weep holes 102 allow the bearing area (on inlet and/or outlet side) to be pressurized to a greater pressure than within the operating area of the pump to exclude pumped fluid. In still another embodiment, bearings 100A and 100B are employed whereby pumped fluid exclusion is not required. In another embodiment weep holes 130 allow fluid to pass into and through said bearings thus providing for bearing clean out. In yet another embodiment, a hydrostatic bearing using the pumped fluid as the lubricating fluid is utilized. And in still yet another embodiment, a hydrodynamic bearing using the pumped fluid as the lubricating fluid is utilized. These bearing support arrangements allows for virtually free rotation of rotor 14 while constraining radial and axial motion with respect to stator 12, providing support for any forces generated by said rotor motion. Other bearing support systems are also possible, and considered within the scope of this invention.

Operation

Referring back to FIGS. 2A–B, in normal operation, inlet fluid flow 132 is directed into inlet housing 18. The round or parabolic ended cylinder 96 of inlet housing 18 causes inlet fluid flow 132 to gently separate and flow into inlet side 26 of motor housing 16. Motor control module (MCM) 34, drawing energy from an electrical power source, provides current to at least one phase windings 43 in order to produce clockwise (CW) rotation 62 (FIG. 3). (It should be appreciated that a counter-clockwise rotation does not depart from the scope of this invention.) Specifically, when currents are fed to windings 43 surrounding an ordered set of stator magnetic poles 40, the nearest rotor magnetic vanes 46 are electromagnetically interacting with the excited stator magnetic poles 40, thereby creating a force on rotor 14 that causes it to move relative to stator 12. Sequentially moving the current excitation from one ordered set of stator poles 40 to another in a continuous manner causes rotor 14 to rotate steadily relative to stator 12. As rotor 14 rotation occurs, the plurality of magnetic vanes 46 propel the fluid flow 132 axially along the rotor. Specifically, as rotor 14 rotates, the plurality of magnetic vanes 46 impart force on fluid flow 132 causing an increase in energy as the fluid traverses the fluid carrying channels 48 (see FIGS. 2A–B and 3) from inlet side 26 to outlet side 28. This imparted energy increase propels fluid flow 132 flow past rotor 14. Thus, rotor 14 simultaneously functions as a motor rotor and a pump impeller, with the plurality of magnetic vanes 46 propelling the fluid flow 132 axially along rotor 14 and thus motor housing 16. After being propelled through motor housing 16, fluid flow 132 becomes outlet flow 132A having axial and rotational velocity components and enters outlet housing 20. The curved shaped vane structures 122 and cone-ended cylinder 128 gently remove rotation and return flow 132A to an axial flow. Through this diffusing process, kinetic energy is transferred into a higher outlet pressure. A smooth diffusion process improves pump efficiency.

With continuing reference to FIG. 2, as pumping operation occurs, heat is generated, in part, in windings 43 due to electric current flow and, in part, due to hysteresis and eddy currents in rotor 14 and stator 12, and, in part, due to other mechanical and electromechanical interactions. Heat generation and temperature rises from such heat can have detrimental effects on pump parts resulting in shorter lives and unpredictable failures. However, because fluid flow contacts parts of fluid pump/generator 10, fluid flow acts to remove the generated heat. For example, each winding channel allows fluid flow therethrought. This aspect of this invention allows for increased energy density within the pump resulting in a geometrically smaller pump size. Additionally, the efficiency and longevity of this pump system is enhanced due to this cooling. Additional cooling is achieved as described below.

Typical specifications for a fluid pump/generator device herein described for use in a vehicle cooling system would include a rotor of diameter range between one inch and four inches. Pumping pressures range from 0 psi to 45 psi and flow rates range from 0 gpm to 125 gpm. Due to the numerous application possibilities, MCM 34 can be easily converted for a range of voltages, inputs vary between 8 to 260V dc, possibly being rectified from ac mains having frequencies ranging from 50 Hz to 400 Hz. Pump speeds would range between 0 rpm to 6500 rpm. Pumping energy is provided by creating torque to rotate rotor 14. The diameter, length, number and shape of stator magnetic poles 40 and rotor magnetic vanes 46 depends on motor performance requirements which include rotational speed, supplied torque, and internal heat generation. This invention combines the requirements of both motor and pump. Rotor 14 shape, including diameter, axial length, vane 46 shape and channel 48 shape and axially angling of vane 46 as herein described depends on pumping performance parameters which include rotor rotational speed, pressure increase, flow rate, and type and condition of pumped fluid.

ALTERNATIVE EMBODIMENTS

Figure 18:
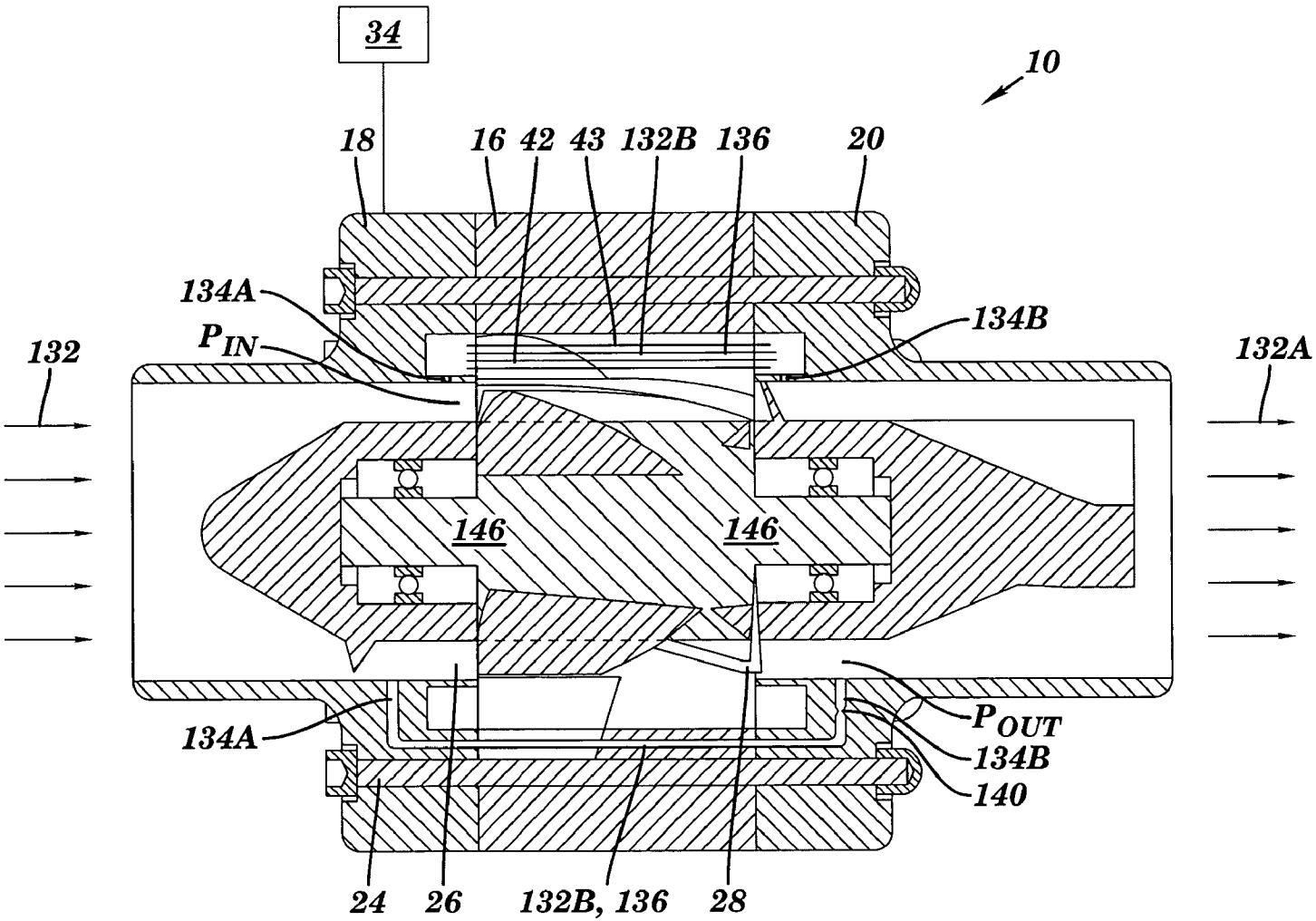
FIG. 18 shows a cross-sectional view of an alternative embodiment for cooling a motor housing of FIG. 2.

Referring to FIG. 18, fluid pump 10 may further comprise a plurality of holes 134A and 134B that communicate with fluid flow 132 from inlet housing 18 and outlet housing 20, respectively. During pump operation, the plurality of holes 134A and 134B communicate a portion of fluid flow 132, i.e., a channel flow 132B, through motor housing 16 and then back to fluid flow 132, resulting in cooling via a plurality of flow areas 136. Flow areas 136 may extend around and through phase windings 43 in winding channels 42 (top FIG. 18), and/or simply through motor housing 16 (bottom FIG. 18). As rotor 14 rotates and pumping occurs, pout, outlet side 28 pressure is greater than, pin, inlet side 26 pressure. The difference of pressure between pout and pin causes a portion of outlet fluid flow 132A to become cooling flow through flow areas 136. Cooling flow rates are controlled by the flow area and flow restriction caused by the diameter of holes 134A and holes 134B or flow restrictors 140, if required. The cooling flow removes heat generated from pump operation. The above-described cooling channels may be used individually or in combination.

Figure 19:
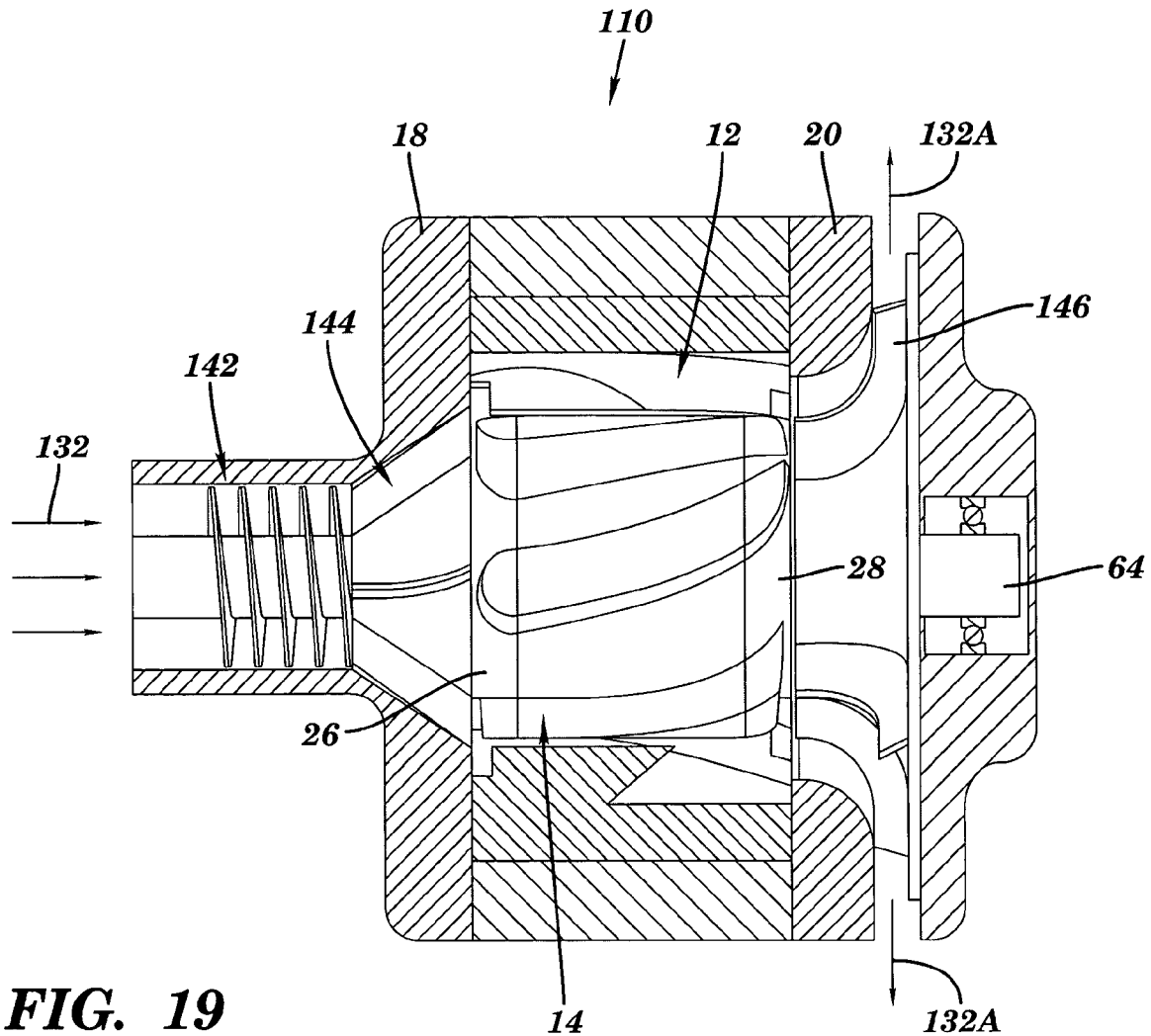
FIG. 19 shows a cross-sectional view of an alternative embodiment of the invention including a input flow inducer, an input impeller and an output impeller.

Referring to FIG. 19, an alternative embodiment of a fluid pump 110 is shown. In this embodiment, an inducer 142 and/or mixed flow impeller 144 is attached to rotor 14 at inlet end 26 to enhance flow and pressure resulting in increased performance. Preferably, inducer 142 is attached in front of inlet side 26 of rotor 14. It should be recognized that due to these additions, the design and shape of inlet housing 18 will most likely change. In this embodiment inducer 142 is not part of an electromechanical structure of fluid pump 10, but still remains an integral part of rotor 14. The inducer 142 can be a separate part, even of separate material, affixed to rotor 14, or it can be of a plurality of layers affixed to rotor 14.

In addition to inducer 142, or as a replacement therefor, an inlet flow impeller 144 may be attached to rotor 14 at inlet end 26 to enhance flow and pressure resulting in increased performance. In addition to inducer 142 and/or flow impeller 144, or as a solitary addition, an outlet flow impeller 146 may also be attached to rotor 14 at outlet side 28 to enhance flow and pressure resulting in increased performance. As shown in FIG. 19, output flow impeller 146 is preferably a centrifugal or mixed, mostly centrifugal, flow impeller. Necessary shrouding to redirect fluid flow to a linear flow are well known in the art. It should be recognized that due to these additions the design, and shape of outlet housing 20 will most likely change. As illustrated, outlet housing 20 may support rotor 14 by supporting rotor shaft 64, and removing rotation out of outlet flow 132A will remain the same. This approach can also employ a volute redirecting the axial inlet flow to a radially channeled outward flow. In this embodiment the centrifugal and/or mixed flow outlet impeller 146 is not part of an electrical circuit of fluid pump 10, but still remains an integral part of rotor 14. The centrifugal and/or mixed flow impeller can be a separate part, even of separate material, affixed to the rotor or it can be of lamination design affixed to the rotor.

In yet another alternative embodiment of the first embodiment of fluid pump 10 to enhance the pump performance, a set of axial blade structures may be attached on rotor 14. The set of axial blade structures can be added either on outlet side 28 between rotor 14 and support system 129 in outlet housing 20 or on inlet side 26 between rotor support system 90 and rotor 14, or in both places.

Figure 20:
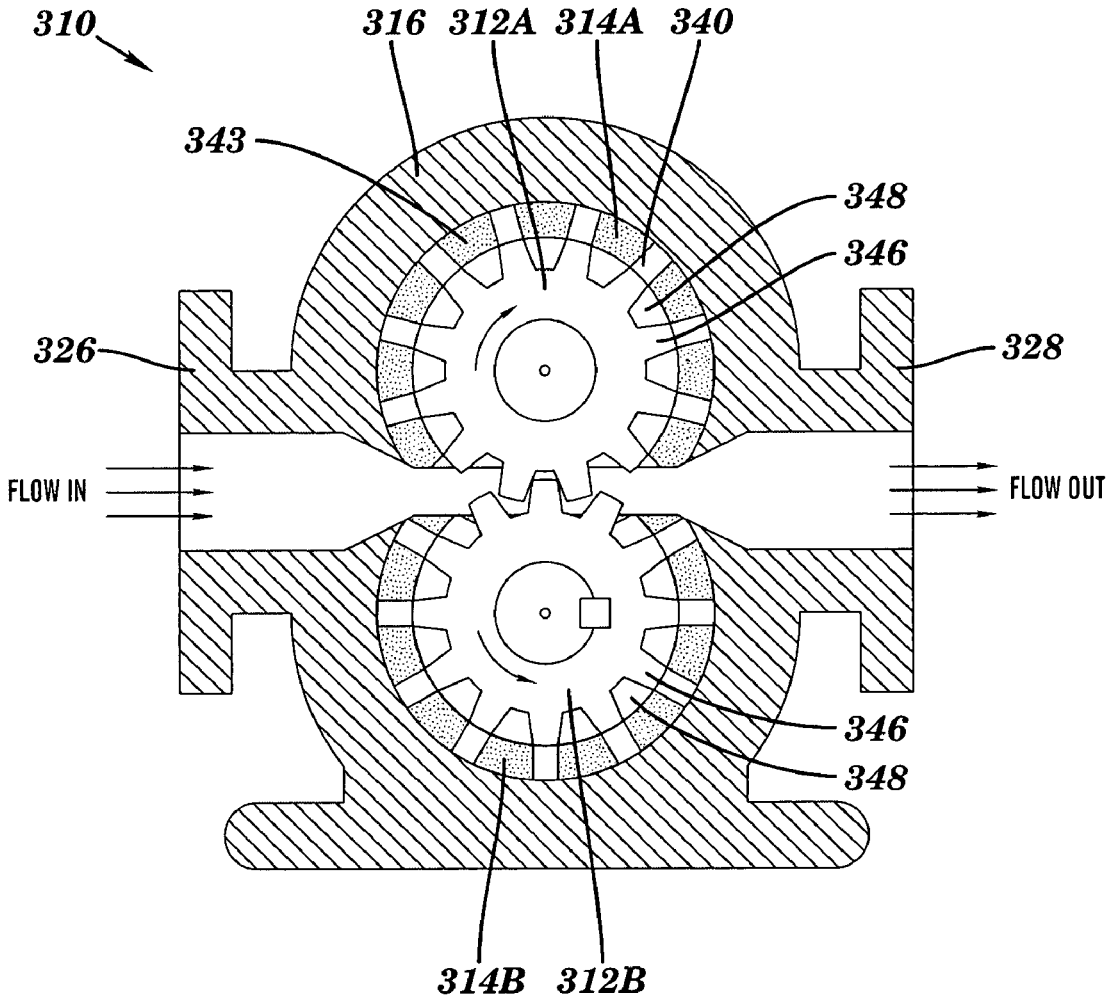
FIG. 20 shows a cross-sectional view of an alternative embodiment of the fluid pump/generator according to the invention.
Figure 21:
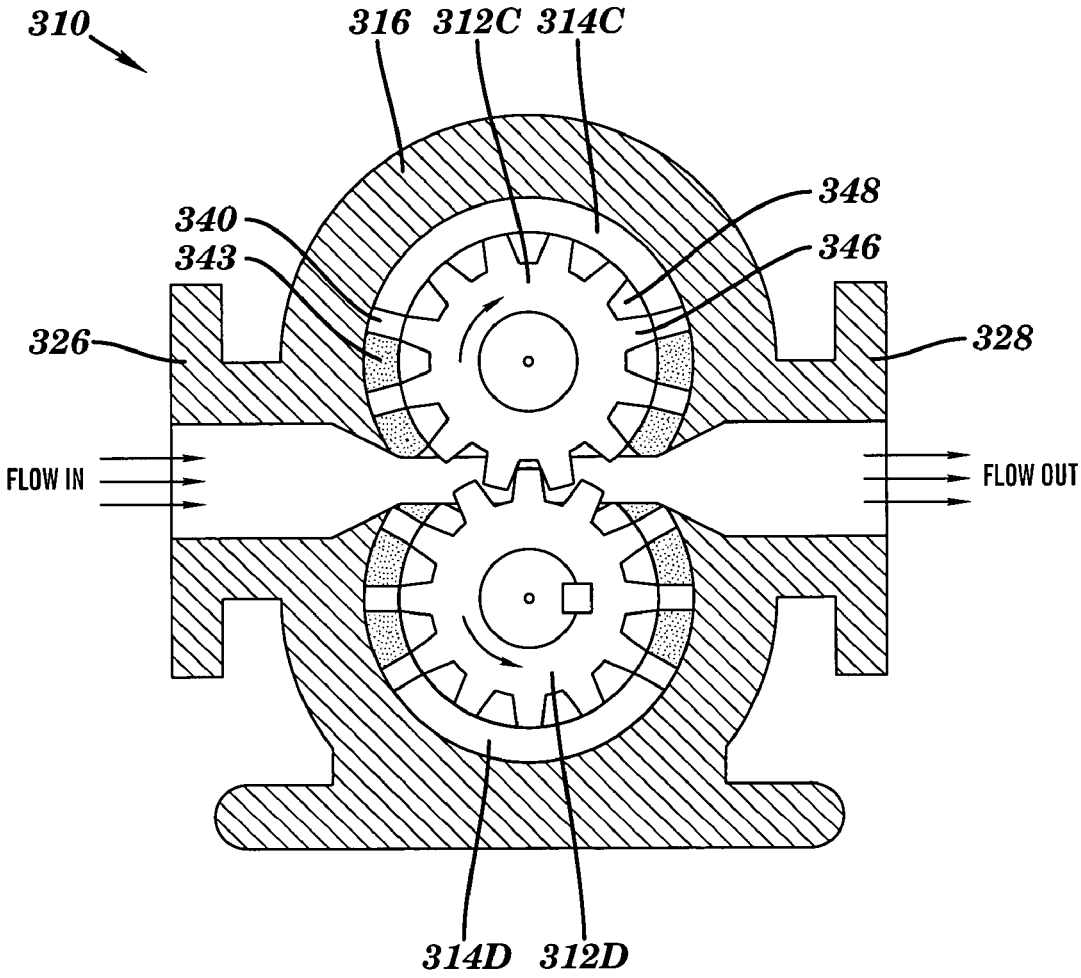
FIG. 21 shows a cross-sectional view of another alternative embodiment of the fluid pump/generator of FIG. 20.

FIG. 20 and FIG. 21 show a second embodiment of a fluid pump/generator device 310. In this embodiment, a fluid pump/generator 310 comprises at least two rotors 312A, 312B (or 312C and 312D in FIG. 21), with the magnetic vanes 346 of one rotor meshing with flow channels 348 of one another rotor. In the embodiments shown in FIGS. 20 and 21, a gear pump includes two rotors 312A, 312B (or 312C, 312D in FIG. 21), meshing with each other. The rotors 312A, 312B (or 312C, 312D in FIG. 21) being radially captured and enclosed by stators 314A, 314B (or 314C, 314D in FIG. 21), with the stators having a plurality of magnetic poles 340, and at least one phase windings 343. The stators are included in housing 316. The rotors include a plurality of magnetic vanes 346, and a plurality of channels 348, the plurality of magnetic vanes 346 each having an involute shape as described above (and shown in FIG. 8). The magnetic vanes 346 of one rotor meshing with flow channels 348 of the other rotor. FIG. 20 shows stators that as fully as possible enclose their corresponding rotors, set one being rotor 312A and stator 314A and set two being rotor 312B and stator 314B. FIG. 21 shows stators that symmetrically enclose their corresponding rotors, set one being rotor 312C and stator 314C and set two being rotor 312D and stator 314D. Among other things, symmetrical stators reduce uneven shaft loading thereby increasing overall motor and pump performance.

In the embodiments shown in FIG. 20 and FIG. 21, (description hereinafter is based on FIG. 20), pumping occurs when at least two rotors 312A and 312B counterrotate with respect to one another, moving fluid from inlet side 326 to outlet side 328 tangentially around an outer diameters of each of the at least two rotors 312A and 312B, in the plurality of channels 348, as one skilled in the art would appreciate as a gear pump embodiment. The integrated motor includes rotors 312A and 312B, and stators 314A and 314B, whereby stator 314A interacts rotor 312A and stator 314B interacts rotor 312B, causing the rotors to rotate. It will be appreciated by those skilled in the art of gear pumps and gear-like pumping that meshing of rotor 312A and 312B can be determined by specially shaped vanes 346, such as by previously described involute shapes, or other shapes that result in proper meshing and pumping action, or meshing can be achieved by an independent form rotor device, such as meshing timing gears, affixed to the rotor shafts and dictating rotor 312A location relative to rotor 312B location, but not being part of the rotor magnetic or pumping structure.

While the SRM is particularly well suited to the embodiments described here, any electric motor with a magnetic structure that allows fluid to flow directly through the rotor is also appropriate. Such motors would typically have permanent magnets and salient poles, as in hybrid stepping motors.

It will be appreciated by those skilled in the art that the following features may be accomplished by various means without departing from the scope of this invention: (a) surface treatments to magnetic vanes and magnetic poles to enhance corrosion resistance; (b) surface treatments to any channels contacting fluid to enhance fluid flow; and (c) combinations of (a) and (b) to enhance corrosion resistance and fluid flow simultaneously.

The invention herein described can be assembled and manufactured in various ways, especially by combining separate and individual parts described herein into a single part or, vice versa, by separating single parts herein described into one or more individual parts, for any number of reasons including but not limited to ease of manufacturing, cost issues, and already existing parts. Such separating and or combining however do not depart from the scope of this invention.

Generator

While the description of the preferred embodiments of the invention discuss the operation of a fluid pump, it will be appreciated that the present invention similarly supports reciprocal operation as a turbine driven generator. Referring to FIG. 2, in generator operation, fluid flow is driven into motor housing 16 from outlet side 28, interacting with magnetic vanes 46. Magnetic vanes 46 are driven to move by the force of fluid flow, which causes rotor 14 to rotate anti-clockwise relative to stator 12. When rotor 14 rotates anti-clockwise, magnetic vanes 46 electrically interact with magnetic poles 40, which generates electricity in phase windings 43.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

What is claimed is:

1. A fluid pump/generator comprising:

a motor including:

a stator having a plurality of magnetic poles, a plurality of winding channels between adjacent magnetic poles, each winding channel allowing fluid flow therethrough, and at least one phase winding; and a rotor having a plurality of magnetic vanes for electromagnetically interacting with the plurality of magnetic poles, and a fluid carrying channel between adjacent magnetic vanes.

2. The fluid pump/generator of claim 1, wherein the stator and the rotor each include a plurality of layers including magnetic material.

3. The fluid pump/generator of claim 2, wherein the plurality of magnetic vanes each have a curved shape for propelling the fluid.

4. The fluid pump/generator of claim 3, wherein each layer of the rotor is offset relative to an adjacent layer to form the curved shape of each magnetic vane.

5. The fluid pump/generator of claim 1, wherein the plurality of magnetic vanes are axially aligned relative to one another.

6. The fluid pump/generator of claim 1, wherein each magnetic vane includes a face width and a base width, wherein the face width is less than the base width.

7. The fluid pump/generator of claim 1, wherein the plurality of magnetic vanes propel the fluid axially along the rotor.

8. The fluid pump/generator of claim 1, wherein the magnetic poles are axially aligned relative to one another.

9. The fluid pump/generator of claim 1, further comprising a set of axial blade structures extending from the rotor.

10. The fluid pump/generator of claim 1, further comprising an inlet housing for directing fluid to the motor, the inlet housing including an outer annulus structure having a passage therethrough, and a nose structure in the passage coupled to the outer annulus by a plurality of vane structures.

11. The fluid pump/generator of claim 1, wherein each vane structure has one of a straight airfoil and a cambered shape.

12. The fluid pump/generator of claim 1, further comprising a motor housing for enclosing the motor.

13. The fluid pump/generator of claim 12, further comprising means for passing the phase winding through the housing to an electronic controller.

14. The fluid pump/generator of claim 1, wherein the stator further comprises at least one bearing seat, each bearing seat for holding a rotor bearing for rotatably supporting the rotor.

15. The fluid pump/generator of claim 1, further comprising an outlet housing for directing fluid from the motor, wherein the outlet housing includes an outer annulus structure having a passage therethrough and a tail structure in the passage, the tail structure coupled to the outer annulus structure by a plurality of vane structures, each vane structure having a curved shape.

16. The fluid pump/generator of claim 1, further comprising a flow inducer attached at an inlet end of the rotor.

17. The fluid pump/generator of claim 16, further comprising a flow impeller attached between the flow inducer structure and the rotor.

18. The fluid pump/generator of claim 1, further comprising a flow impeller attached at an in let end of the rotor.

19. The fluid pump/generator of claim 1, further comprising a first flow impeller attached at an outlet end of the rotor.

20. The fluid pump/generator of claim 19, further comprising a flow inducer attached at an inlet end of the rotor.

21. The fluid pump/generator of claim 20, further comprising a second flow impeller attached between the flow inducer structure and the rotor.

22. The fluid pump/generator of claim 1, further comprising a plurality of cooling channels extending through the stator, wherein the plurality of cooling channels communicate with fluid flow and allow fluid flow through the stator.

23. The fluid pump/generator of claim 1, further comprising at least two adjacent rotors, wherein magnetic vanes of one rotor mesh with fluid carrying channels of the other rotor.

24. The fluid pump/generator of claim 23, wherein the at least two rotors counterrotate with respect to one another and move fluid tangentially around an outer diameter of each of the at least two rotors.

25. A rotor for a fluid pump/generator, the rotor comprising:

a plurality of magnetic layers having a plurality of magnetic vanes formed in an exterior surface thereof; and a plurality of fluid carrying channels between adjacent magnetic vanes;

wherein each magnetic vane includes a face width and a base width, wherein the face width is less than the base width.

* * * * *